US011650535B2

(12) United States Patent
Okamoto

(10) Patent No.: US 11,650,535 B2
(45) Date of Patent: May 16, 2023

(54) TONER COLLECTION DEVICE AND IMAGE FORMING APPARATUS THEREWITH

(71) Applicant: KYOCERA Document Solutions Inc., Osaka (JP)

(72) Inventor: Kazuhiro Okamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/688,475

(22) Filed: Mar. 7, 2022

(65) Prior Publication Data

US 2022/0291624 A1 Sep. 15, 2022

(30) Foreign Application Priority Data

Mar. 12, 2021 (JP) ..... JP2021-040402

(51) Int. Cl.
*G03G 21/10* (2006.01)

(52) U.S. Cl.
CPC ..... *G03G 21/105* (2013.01)

(58) Field of Classification Search
CPC ..... G03G 21/105
See application file for complete search history.

(56) References Cited

U.S. PATENT DOCUMENTS 6,782,235 B2 * 8/2004 Serizawa ..... G03G 21/12 399/358
7,899,345 B2 * 3/2011 Ishii ..... G03G 21/12 399/35
2014/0016977 A1 * 1/2014 Kakitani ..... G03G 21/12 399/360

FOREIGN PATENT DOCUMENTS

JP 2015-94890 A 5/2015

* cited by examiner

*Primary Examiner* — Walter L Lindsay, Jr.
*Assistant Examiner* — Milton Gonzalez
(74) *Attorney, Agent, or Firm* — Stein IP, LLC

(57) ABSTRACT

A toner collection device includes a toner collection container, a toner conveying passage, a side wall, a recessed sensing portion, and a detection sensor. The toner conveying passage includes a first inclined portion provided right under a toner collection port and inclined downward leftward in the left-right direction perpendicular to the up-down direction and a second inclined portion connected to a bottom end part of the first inclined portion and inclined downward frontward in the front-rear direction perpendicular to the up-down and left-right directions, with an end part of the second inclined portion on the left side in contact with the inner wall face of the toner collection container on the left side. The recessed sensing portion has an opening between a top end part of the side wall and the inner wall face of the toner collection container.

4 Claims, 9 Drawing Sheets

TONER COLLECTION DEVICE AND IMAGE FORMING APPARATUS THEREWITH

INCORPORATION BY REFERENCE

This application is based upon and claims the benefit of priority from the corresponding Japanese Patent Application No. 2021-040402 filed on Mar. 12, 2021, the entire contents of which are hereby incorporated by reference.

BACKGROUND

The present disclosure relates to a toner collection device and an image forming apparatus provided with a toner collection device.

Conventionally common image forming apparatuses using an electrophotographic process (copiers, printers, facsimiles, etc.) typically use a process involving visualizing an electrostatic latent image formed on an image carrying member such as a photosensitive drum using toner (powdery developer) in a developing device, transferring the toner image to a recording medium directly or via an intermediate transfer member, and then fixing the image. Such image forming apparatuses incorporate a cleaning device for removing unused toner left on the surface of the image carrying member or the intermediate transfer member. The unused toner removed by the cleaning device is conveyed into a toner collection container to be stored there as waste toner. The toner collection container is replaceable and is replaced by an operator (a user, a maintenance worker, etc.).

The cleaning device includes a waste toner conveying unit for conveying waste toner. The waste toner conveying unit includes a toner conveying passage and a conveying screw for conveying toner. In a downstream-side end part of the toner conveying passage, an opening is formed. The opening and a toner collection port formed in a top part of the toner collection container are arranged over each other. Waste toner in the toner conveying passage is conveyed to the opening by the conveying screw and is fed through the opening and the toner collection port into the toner collection container. The step of removing unused toner on the image carrying member is performed continuously while the image forming apparatus is forming images. During the step of removing unused toner, waste toner is constantly fed into the toner collection container.

Also known are toner collection devices provided with a detection sensor that can sense the amount of toner in the toner collection container.

Such a detection sensor is arranged around the toner collection port so as to sense a state of a sufficient amount waste toner being stored in the toner collection container. The detection sensor is an optical sensor such as a photointerruptor and includes a light emitting portion that emits light and a light receiving portion that receives the light emitted from the light emitting portion. The light emitting portion and the light receiving portion are arranged so as to sandwich, at a predetermined position in the toner collection container in the up-down direction, the toner collection container from both sides in its width direction (the direction perpendicular to the up-down direction). The detection sensor is connected to a control portion provided in an appropriate part of the image forming apparatus. The detection sensor senses the presence or absence of waste toner between the light emitting portion and the light receiving portion (the predetermined position mentioned above) and transmits the sensing result to the control portion.

When waste toner accumulates gradually in the toner collection container and reaches the predetermined position mentioned above, the light emitted from the light emitting portion is intercepted by waste toner and the light reception condition in the light receiving portion changes. When the sensing result is transmitted to the control portion, the control portion displays an indication about the time for replacement of the toner collection container on an operation screen or the like of the image forming apparatus.

SUMMARY

According to one aspect of the present disclosure, a toner collection device includes a toner collection container, a toner conveying passage, a side wall, a recessed sensing portion, and a detection sensor. The toner collection container has a toner collection port formed in it through which waste toner on a toner carrying member is fed in. The toner collection container can store in it the waste toner fed in through the toner collection port. The toner conveying passage includes a first inclined portion that is provided right under the toner collection port and that is inclined downward leftward in the left-right direction perpendicular to the up-down direction and a second inclined portion that is connected to a bottom end part of the first inclined portion and that is inclined downward frontward in the front-rear direction perpendicular to the up-down and left-right directions such that an end part of the second inclined portion on the left side makes contact with the inner wall face of the toner collection container on the left side. The toner conveying passage conveys the waste toner fed in through the toner collection port toward a bottom portion of the toner collection container along the first and second inclined portions. The side wall rises from an end part of the second inclined portion on the right side. The recessed sensing portion has an opening between a top end part of the side wall and the inner wall face of the toner collection container. The recessed sensing portion communicates with the second inclined portion on the rear side. The detection sensor senses the presence or absence of waste toner at a predetermined position in the recessed sensing portion in the up-down direction.

DETAILED DESCRIPTION

Figure 1:
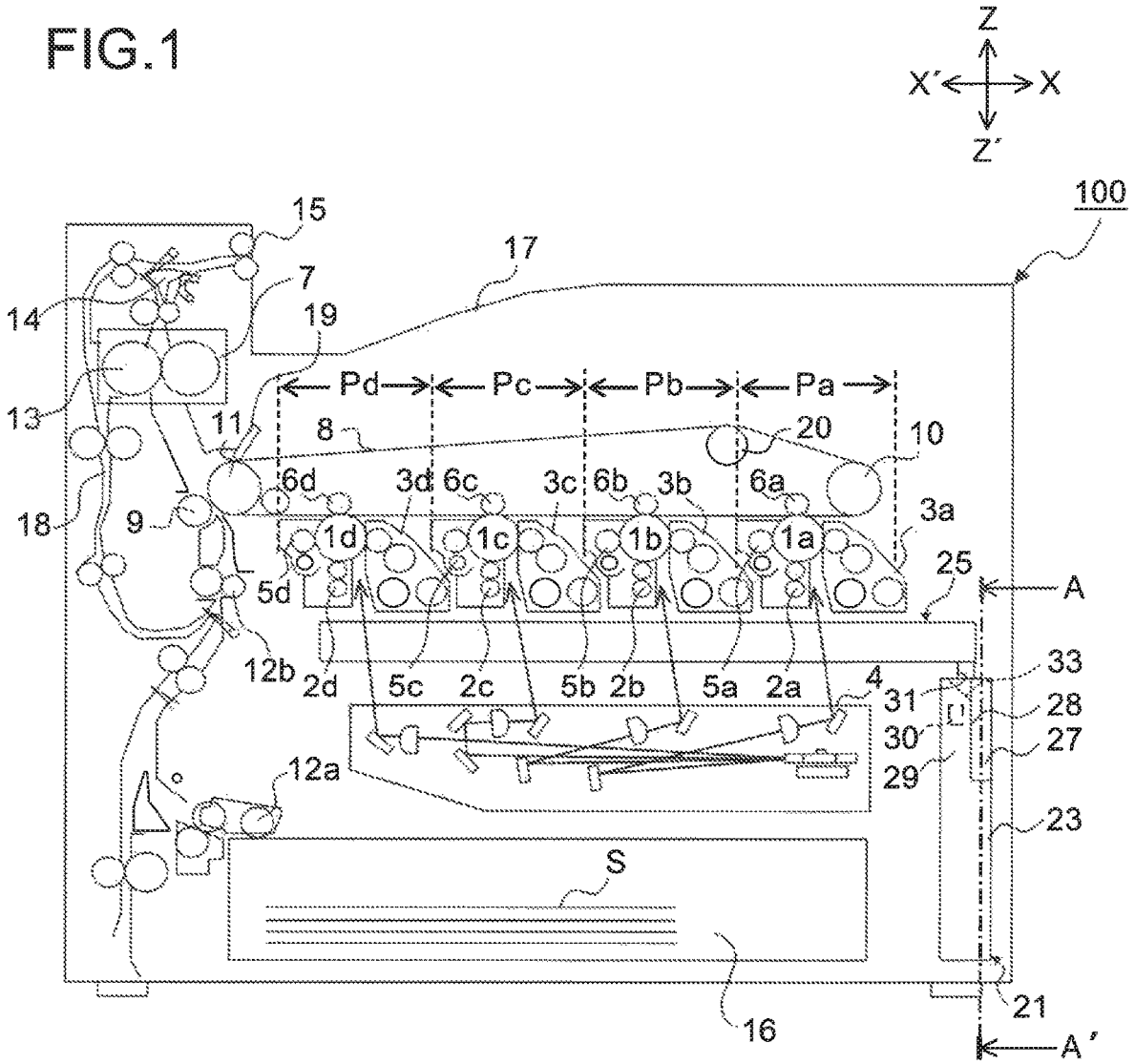
FIG. 1 is a schematic sectional view of an image forming apparatus mounted with a toner collection device according to the present disclosure.

Hereinafter, with reference to the accompanying drawings, embodiments of the present disclosure will be described. FIG. 1 is a schematic sectional view of an image forming apparatus 100 mounted with a toner collection device 21 according to the present disclosure. In the main body of the image forming apparatus 100 (here, a color printer), four image forming portions, Pa, Pb, Pc and Pd are arranged in this order from the upstream side in the conveying direction (from the right side in FIG. 1). The image forming portions Pa to Pd correspond to images of four different colors (magenta, cyan, yellow, and black) and sequentially form images of the different colors through the steps of charging, exposure to light, development, and transfer.

In the image forming portions Pa to Pd, photosensitive drums (toner image carrying members) 1*a* to 1*d* are rotatably arranged which carry visible images (toner images) of the different colors. An intermediate transfer belt 8 is provided adjacent to the image forming portions Pa to Pd. A secondary transfer roller 9 is provided adjacent to the intermediate transfer belt 8.

The intermediate transfer belt 8 is formed of a sheet of dielectric resin and is an endless belt made by superposing and bonding together the opposite ends of the sheet or a seamless belt (belt with no seam). The intermediate transfer belt 8 is stretched around a driven roller 10, a driving roller 11, and a tension roller 20 to rotate together with the driving roller 11 as this rotates.

The secondary transfer roller 9 faces the driving roller 11 across the intermediate transfer belt 8. A nip (secondary transfer nip) is formed between the intermediate transfer belt 8 and the secondary transfer roller 9. On the downstream side of the secondary transfer roller 9 in the rotation direction of the intermediate transfer belt 8, a blade-form belt cleaner 19 is arranged for removing toner left on the surface of the intermediate transfer belt 8.

In a lower part of the image forming apparatus 100, a sheet cassette 16 is provided. Sheets S are stored in the sheet cassette 16. The sheets S in the sheet cassette 16 are conveyed to the secondary transfer nip via a sheet feeding roller 12*a* and a registration roller 12*b*.

Next, a description will be given of the image forming portions Pa to Pd. Provided around and under the photosensitive drums 1*a* to 1*d* are chargers 2*a* to 2*d*, an exposure unit 4, developing units 3*a* to 3*d*, and cleaning portions 5*a* to 5*d*.

The chargers 2*a* to 2*d* electrically charge the photosensitive drums 1*a* to 1*d*. The exposure unit 4 exposes the photosensitive drums 1*a* to 1*d* to light carrying image information. The developing units 3*a* to 3*d* form toner images on the photosensitive drums 1*a* to 1*d*. The developing units 3*a* to 3*d* include developing rollers (developer carrying members) which are arranged opposite the photosensitive drums 1*a* to 1*d*. The developing units 3*a* to 3*d* include toner cartridges (not shown) loaded with predetermined amounts of toner of magenta, cyan, yellow, and black respectively. The cleaning portions 5*a* to 5*d* remove developer (toner) left on the photosensitive drums 1*a* to 1*d*.

When a user enters an instruction to start image formation, first, the chargers 2*a* to 2*d* electrostatically charge the surfaces of the photosensitive drums 1*a* to 1*d* uniformly. Next, the exposure unit 4 irradiates the photosensitive drums 1*a* to 1*d* with light to form on them electrostatic latent images reflecting the image data. Next, the toner in the toner cartridge is fed by the developing rollers in the developing units 3*a* to 3*d* to the photosensitive drums 1*a* to 1*d* respectively, and electrostatically attaches to them. In this way, toner images corresponding to the electrostatic latent images are formed.

Then, an electric field with a predetermined transfer voltage is applied to the intermediate transfer belt 8, and the toner images on the photosensitive drums 1*a* to 1*d* are primarily transferred to the intermediate transfer belt 8 by primary transfer rollers 6*a* to 6*d*. The toner images of four colors to be primarily transferred are formed in a predetermined positional relationship with each other that is prescribed for formation of a predetermined full-color image. Then, in preparation for the subsequent formation of new electrostatic latent images, toner left on the surface of the photosensitive drums 1*a* to 1*d* are removed by the cleaning portions 5*a* to 5*d*.

As the intermediate transfer belt 8 starts to rotate clockwise, a sheet S is conveyed from the registration roller 12*b* to the secondary transfer nip with predetermined timing. Then, a full-color image is secondarily transferred from the intermediate transfer belt 8 to the surface of the sheet S by the secondary transfer roller 9. The sheet S to which the toner images have been transferred is conveyed to a fixing portion 7.

The sheet S conveyed to the fixing portion 7 is heated and pressed as it passes through a nip (fixing nip) of the fixing roller 13. Then, the secondarily-transferred toner images are fixed on the surface of the sheet S, and thus the predetermined full-color image is formed on it. The sheet S on which the full-color image has been formed has its conveyance direction switched by a branch portion 14 branching into a plurality of directions. When an image is formed only on one side of the sheet S, the sheet S is directly discharged onto a discharge tray 17 by a discharge roller 15.

In contrast, when images are formed on both sides of the sheet S, part of the sheet S that has passed through the fixing portion 7 is momentarily stuck out of the apparatus through the discharge roller 15. In that state, by rotating the discharge roller 15 backward, the sheet S is directed, at the branch portion 14, to a sheet conveying passage 18 with the image face (the face on which the image is formed) reversed, and is conveyed again to the secondary transfer nip. Then, the next image formed on the intermediate transfer belt 8 is transferred by the secondary transfer roller 9 to the face of the sheet S on which no image has yet been formed. The sheet S is then conveyed to the fixing portion 7 to have the toner images fixed on it, and is discharged to the discharge tray 17.

In a lower part of the apparatus, a toner collection device 21 is arranged. The toner collection device 21 collects and stores waste toner scraped off at the cleaning portions 5*a* to 5*d* and the belt cleaner 19. The toner collection device 21 is coupled to the cleaning portions 5*a* to 5*d* and the belt cleaner 19 via a waste toner conveying unit 25 (waste toner conveying portion).

Figure 2:
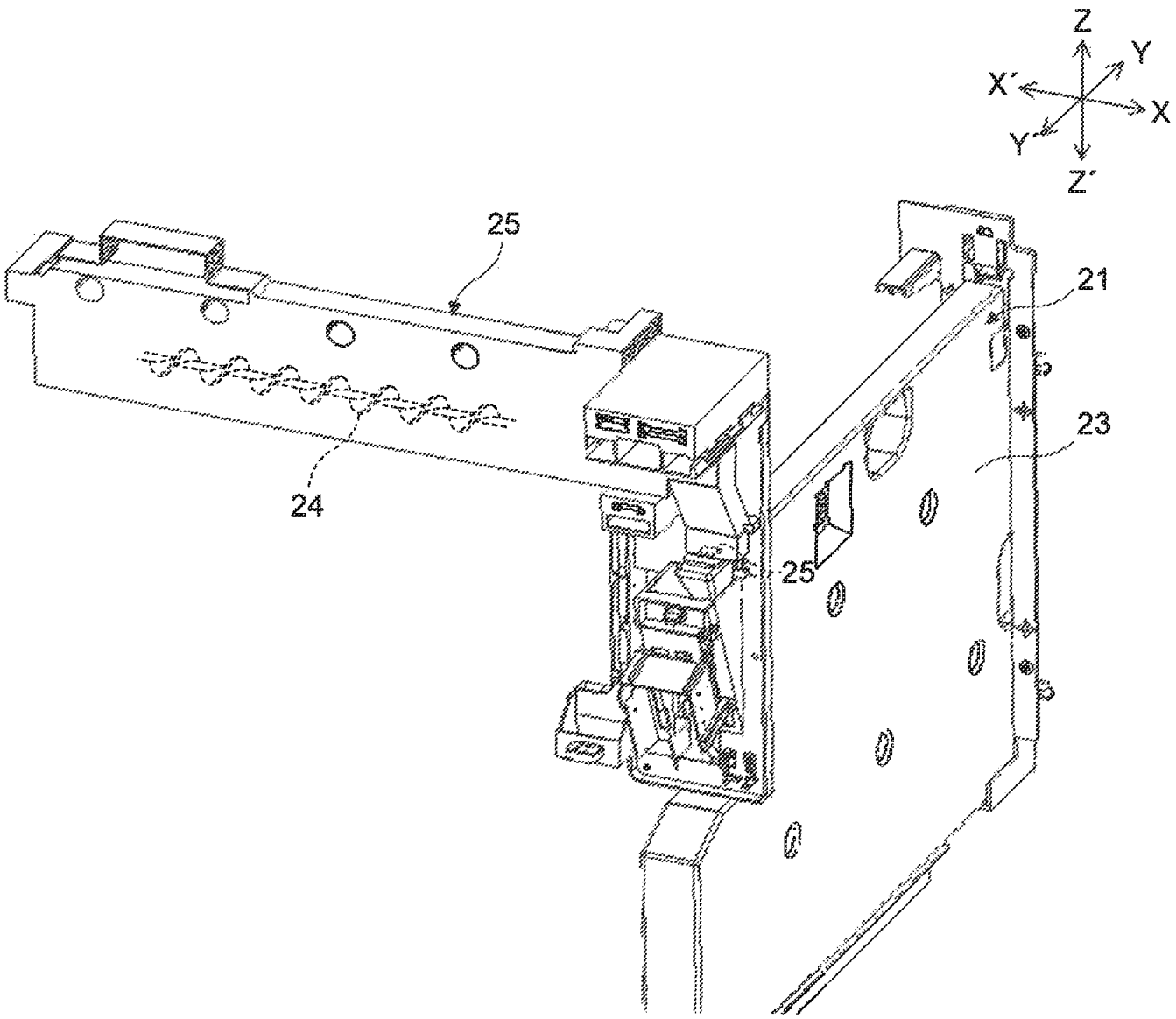
FIG. 2 is a perspective view of the toner collection device and a waste toner conveying unit according to the present disclosure.

The waste toner conveying unit 25 includes a conveying screw 24 inside and has a discharge port 32 formed in it (see FIG. 2). The conveying screw 24 conveys waste toner. The discharge port 32 is located in a downstream-side end part of the waste toner conveying unit 25 in the waste toner conveying direction. The waste toner conveying unit 25 conveys the waste toner collected at the cleaning portions 5*a* to 5*d* and the belt cleaner 19 to the toner collection device 21 through the discharge port 32.

Figure 3:
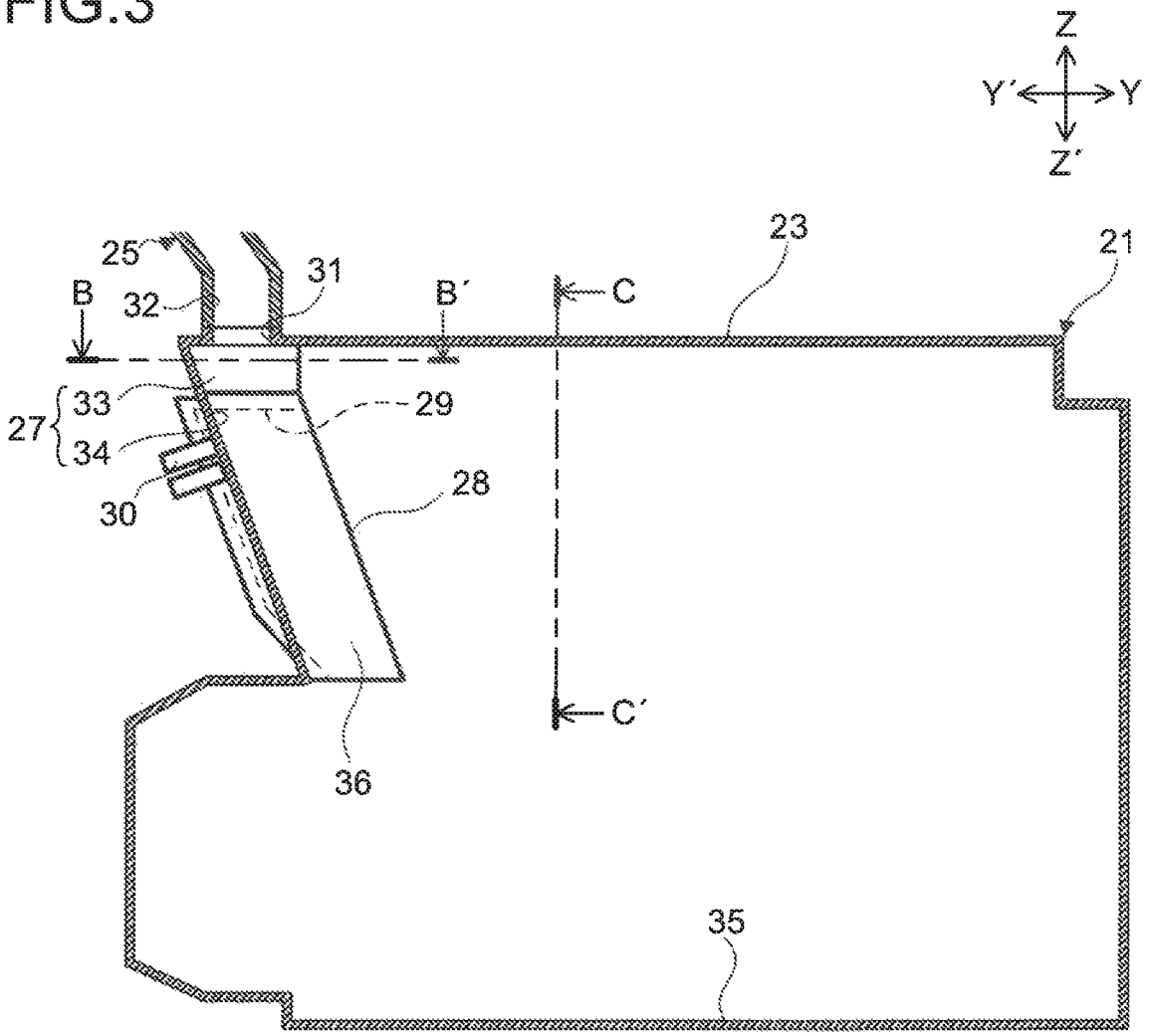
FIG. 3 is a sectional front view (a sectional view cut along section line A-A' in FIG. 1) showing the internal structure of the toner collection device according to the present disclosure.
Figure 4:
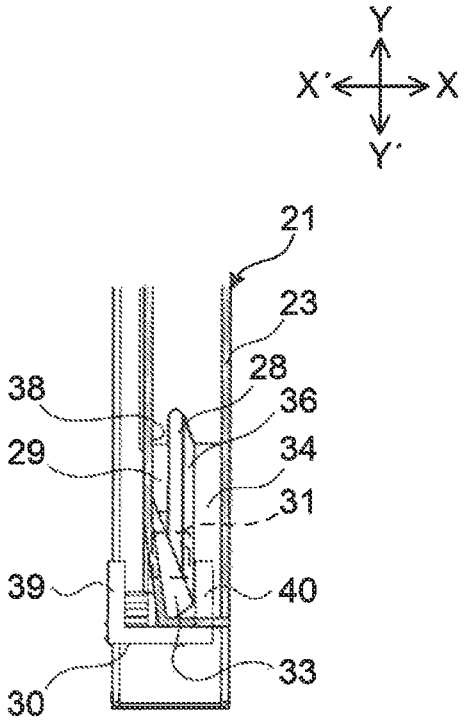
FIG. 4 is a sectional view of the toner collection device according to the present disclosure shown in FIG. 3 cut along section line B-B'.
Figure 5:
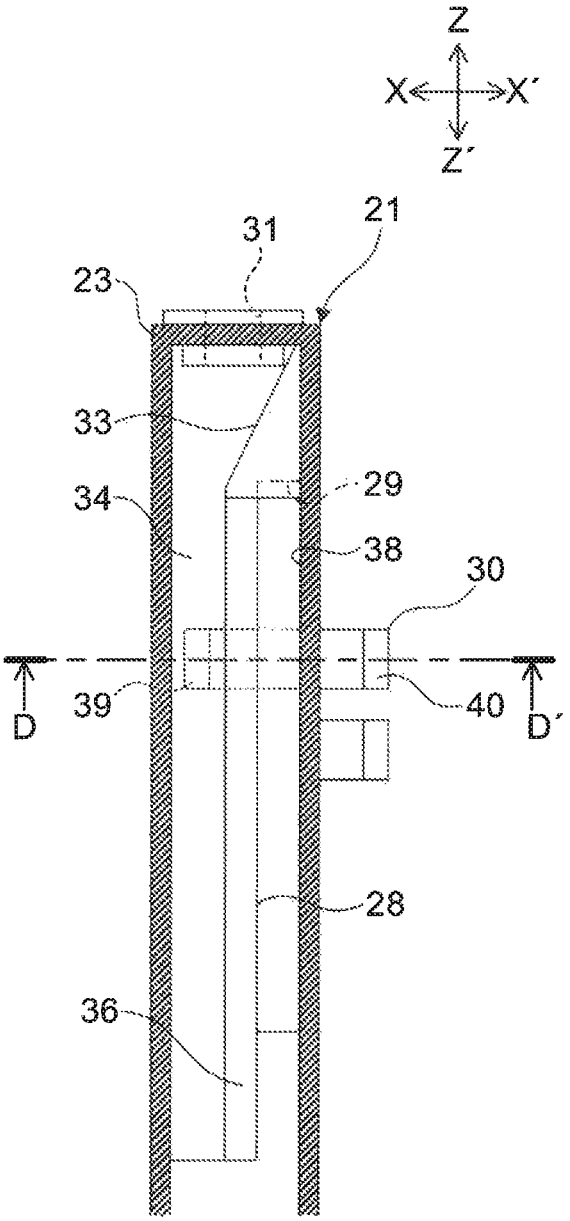
FIG. 5 is a sectional view of the toner collection device shown in FIG. 3 cut along section line C-C'.

FIG. 2 is a perspective view of the toner collection device 21 and the waste toner conveying unit 25 according to the present disclosure. FIG. 3 is a sectional front view (a sectional view cut along section line A-A' in FIG. 1) showing the internal structure of the toner collection device 21 according to the present disclosure. FIG. 4 is a sectional view of the toner collection device 21 shown in FIG. 3 cut along section line B-B'. FIG. 5 is a sectional view of the toner collection device 21 shown in FIG. 3 cut along section line C-C'.

In the following description, of the directions perpendicular to the up-down direction (arrow Z-Z' direction in FIGS. 1, 2, 3, and 5), the direction along the width direction of the image forming apparatus 100 is taken as the left-right direction (arrow X-X' direction in FIGS. 1, 2, 4, and 5). The direction perpendicular to both the up-down and left-right directions is taken as the front-rear direction (arrow Y-Y' direction in FIGS. 2, 3, and 4). Furthermore, one side in the front-rear direction (arrow Y direction in the drawings) is taken as the "front side" and the other side (arrow Y' direction in the drawings) is taken as the "rear side". One side in the left-right direction (arrow X direction in the drawings) is taken as the "left side" and the other side (arrow X' direction in the drawings) is taken as the "right side".

As shown in FIGS. 1 to 3, the toner collection device 21 includes a toner collection container 23, a toner conveying passage 27, a side wall 28, a recessed sensing portion 29, and a detection sensor 30. The toner collection container 23 is a bottomed container that can store in it the waste toner conveyed by the waste toner conveying unit 25. In the top face of the toner collection container 23, a toner collection port 31 is formed. The toner collection port 31 is a through hole that penetrates, in the up-down direction, a top face part of the toner collection container 23. The toner collection port 31 is arranged below the discharge port 32 of the waste toner conveying unit 25. Through the toner collection port 31, the waste toner discharged from the discharge port 32 is fed into the toner collection container 23.

The toner conveying passage 27 is arranged below the toner collection port 31 and conveys the waste toner fed in through the toner collection port 31 into the toner collection container 23. The toner conveying passage 27 includes a first inclined portion 33 provided right under the toner collection port 31 and a second inclined portion 34 coupled with the first inclined portion 33.

As shown in FIGS. 4 and 5, the first inclined portion 33 is a plate-form member that is inclined downward leftward (arrow X direction in FIGS. 4 and 5) in the left-right direction. The waste toner fed in through the toner collection port 31 falls on the first inclined portion 33 to slide down to a bottom end part of the first inclined portion 33. The inclination angle of the first inclined portion 33 (the inclination of the first inclined portion 33 relative to the horizontal plane) is larger than the angle of repose of waste toner.

As shown in FIGS. 3 and 4, the second inclined portion 34 is a plate-form member that is inclined downward frontward (arrow Y direction in FIGS. 3 and 4) in the front-rear direction. The second inclined portion 34 is connected at a top end part of it to the inner wall face of the toner collection container 23 on the rear side and extends frontward from the top end part to a bottom end part. The inclination angle of the second inclined portion 34 (the inclination of the second inclined portion 34 relative to the horizontal plane) is larger than the angle of repose of waste toner. The top end part of the second inclined portion 34 is connected to the bottom end part of the first inclined portion 33. The waste toner that has slid down on the first inclined portion 33 leftward slides down frontward on the second inclined portion 34 and then falls from the bottom end part of the second inclined portion 34 to a bottom portion 35 of the toner collection container 23.

Figure 6:
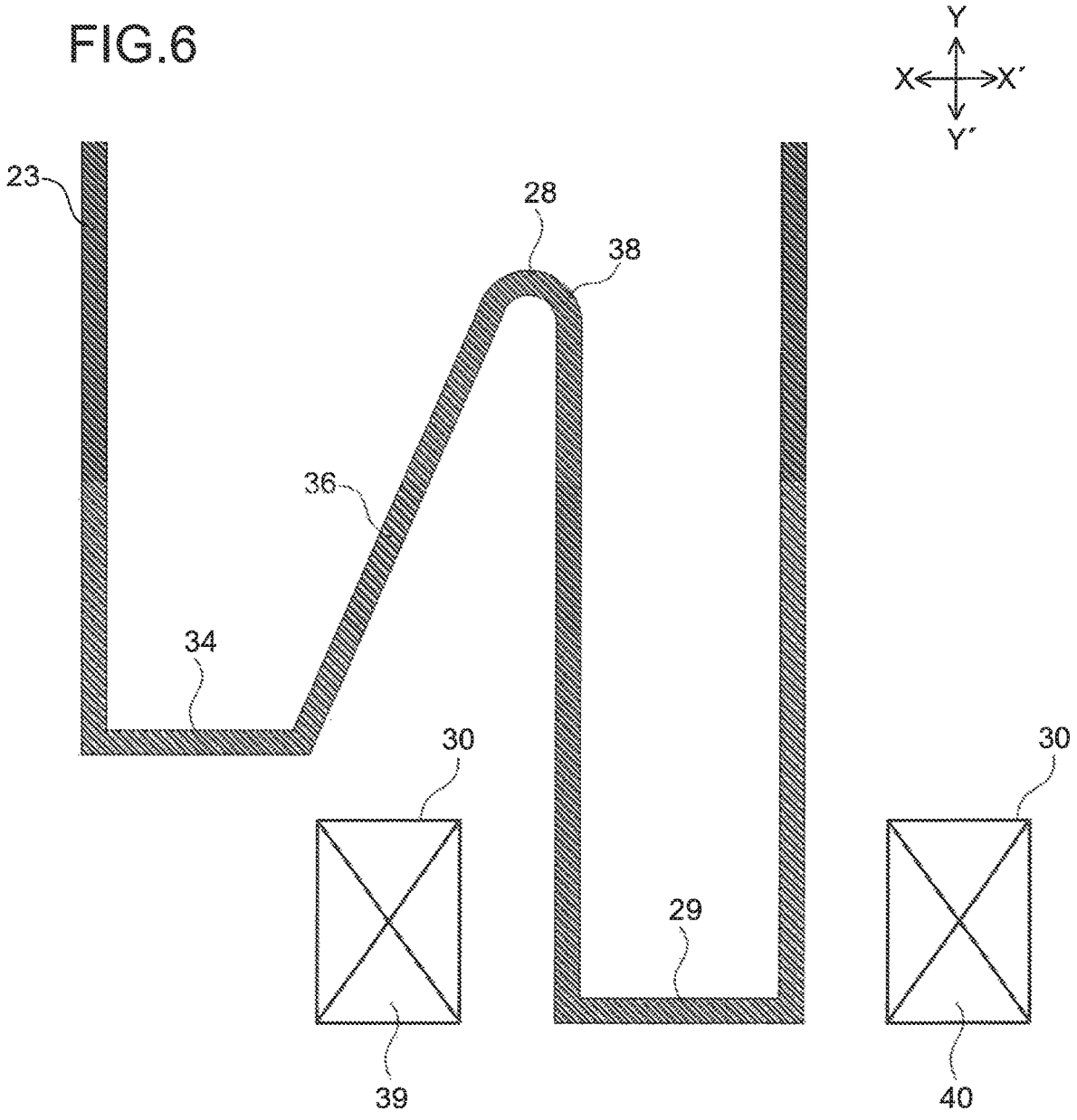
FIG. 6 is a sectional view of the toner collection container cut along section line D-D' in FIG. 5.

FIG. 6 is a sectional view of the toner collection container 23 cut along section line D-D' in FIG. 5. As shown in FIGS. 5 and 6, the side wall 28 is formed so as to rise from an end part of the second inclined portion 34 on the right side. The side wall 28 extends from the top end part to the bottom end part of the second inclined portion 34 along the conveying direction of waste toner (see FIG. 5).

The side wall 28 has a third inclined portion 36 that is connected to an end part of the second inclined portion 34 on the right side. The third inclined portion 36 is inclined downward from its top end (the top of the side wall 28) leftward.

The waste toner that slides down on the second inclined portion 34 passes through a region surrounded by the second inclined portion 34, the inner wall face of the toner collection container 23 on the left side, and the third inclined portion 36. The cross-sectional area of the region surrounded by the side wall 28, the second inclined portion 34, and the toner collection container 23 substantially equals the cross-sectional area of the toner conveying space (the space which is partitioned by the helical blade and the rotary shaft of the conveying screw 24 and in which waste toner is conveyed as the helical blade rotates) of the conveying screw 24 cut on a plane perpendicular to its axis.

As shown in FIG. 6, the recessed sensing portion 29 has an opening 38 between the top of the side wall 28 and the inner wall face of the toner collection container 23 on the right side (in the arrow X' direction) and is recessed from the opening 38 rearward (in the arrow Y' direction). The recessed sensing portion 29 communicates with the internal space of the toner collection container 23 through the opening 38. Waste toner in the toner collection container 23 enters through the opening 38 the recessed sensing portion 29 and accumulates there.

As shown in FIG. 6, the detection sensor 30 is an optical sensor such as a photointerruptor and includes a light emitting portion 39 that emits light and a light receiving portion 40 that receives the light emitted from the light emitting portion 39. The detection sensor 30 is arranged outside the toner collection container 23 so as to overlap with the recessed sensing portion 29 in the front-rear direction. The light emitting portion 39 and the light receiving portion 40 are arranged so as to be located opposite each other across the recessed sensing portion 29 in the left-right direction. The detection sensor 30 is connected to a control portion (omitted from illustration) provided at a predetermined position in the image forming apparatus 100. The result of sensing by the detection sensor 30 is transmitted to the control portion.

The detection sensor 30, based on the light reception condition in the light receiving portion 40, senses the presence or absence of waste toner between the light emitting portion 39 and the light receiving portion 40. Specifically, the light reception condition in the light receiving portion 40 when there is no waste toner between the light emitting portion 39 and the light receiving portion 40 (the state shown in FIG. 6) is taken as a reference state. When waste toner accumulates between the light emitting portion 39 and the light receiving portion 40 (see FIG. 9), the light emitted from the light emitting portion 39 is intercepted by the waste toner and the light reception condition changes from the reference state described above. This sensing result is transmitted to the control portion, and the control portion displays on an operation screen or the like of the image forming apparatus 100 that a predetermined amount of waste toner is stored in the toner collection container 23.

As described above, the waste toner fed in through the toner collection port 31 is, by sliding down on the first and second inclined portions 33 and 34, conveyed through the toner conveying passage 27 to the bottom portion 35 of the toner collection container 23. In the end part of the second inclined portion 34 on the right side, the side wall 28 is provided. Thus, the waste toner fed in through the toner collection port 31 is, while being inhibited from entering the recessed sensing portion 29 by the side wall 28, conveyed through the second inclined portion 34 to the bottom portion 35 of the toner collection container 23.

Figure 7:
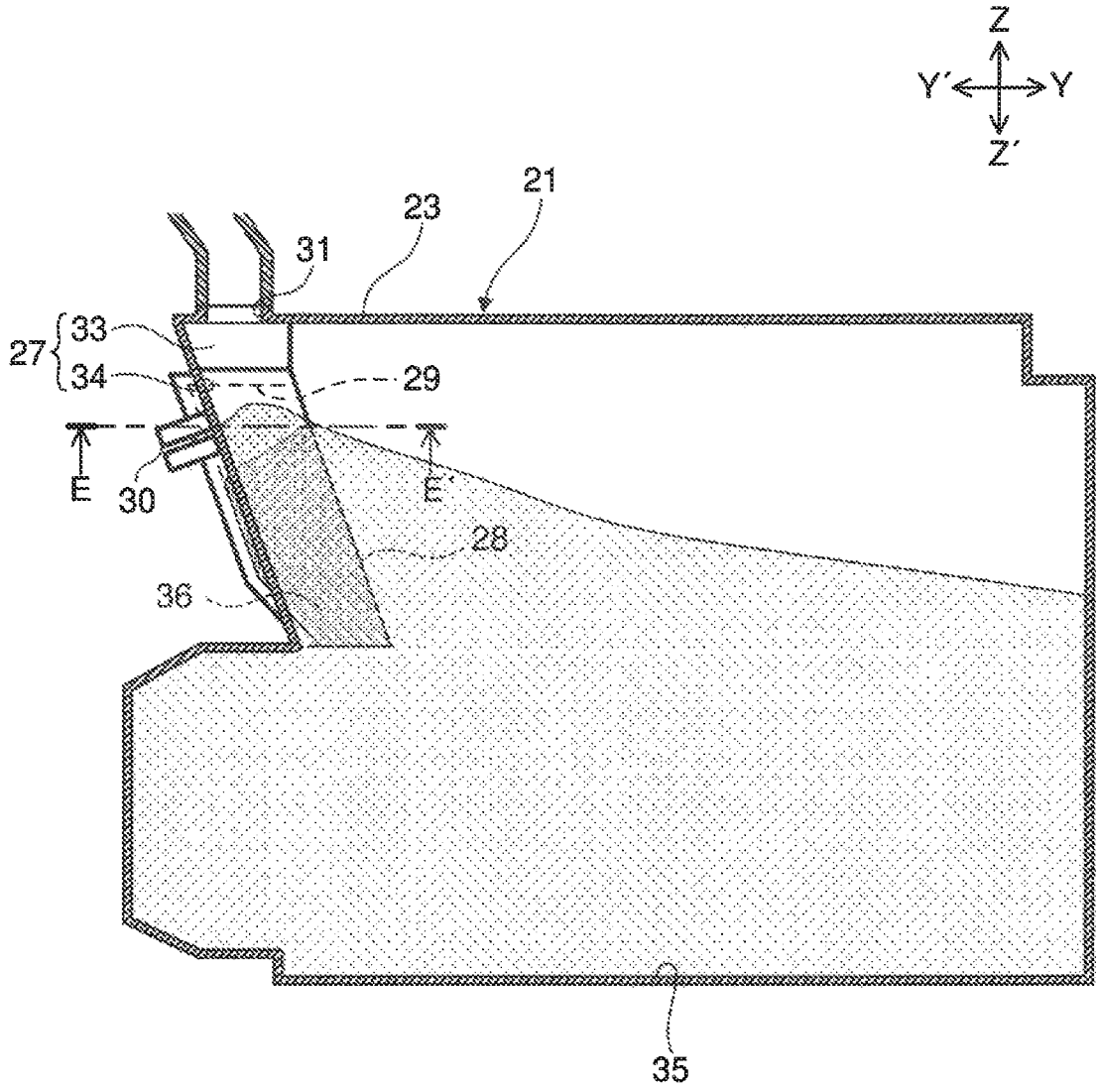
FIG. 7 is a sectional view of the toner collection container showing a state where waste toner is stored in it.
Figure 8:
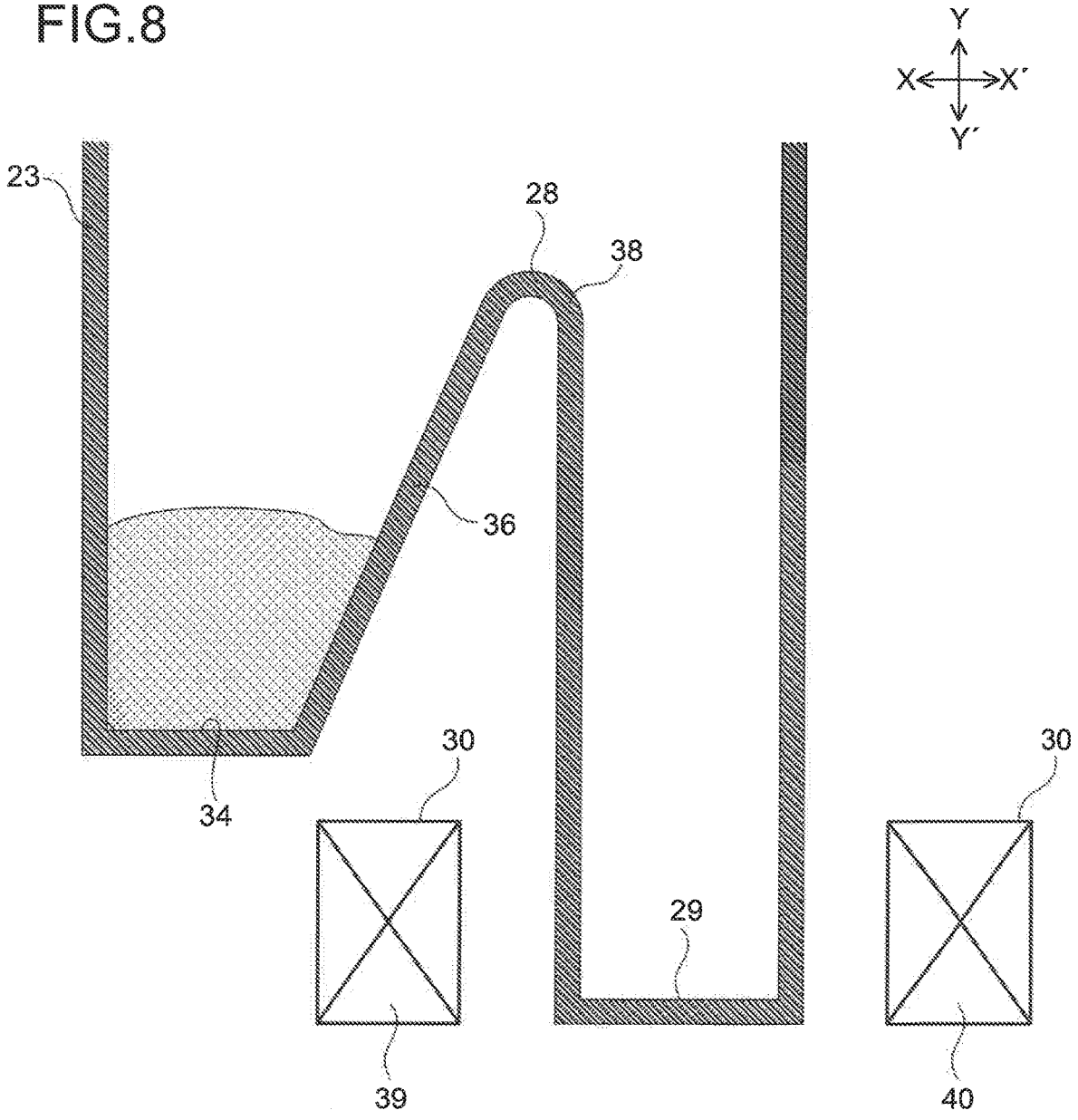
FIG. 8 is a sectional view of the toner collection container shown in FIG. 7 cut along section line E-E'.
Figure 9:
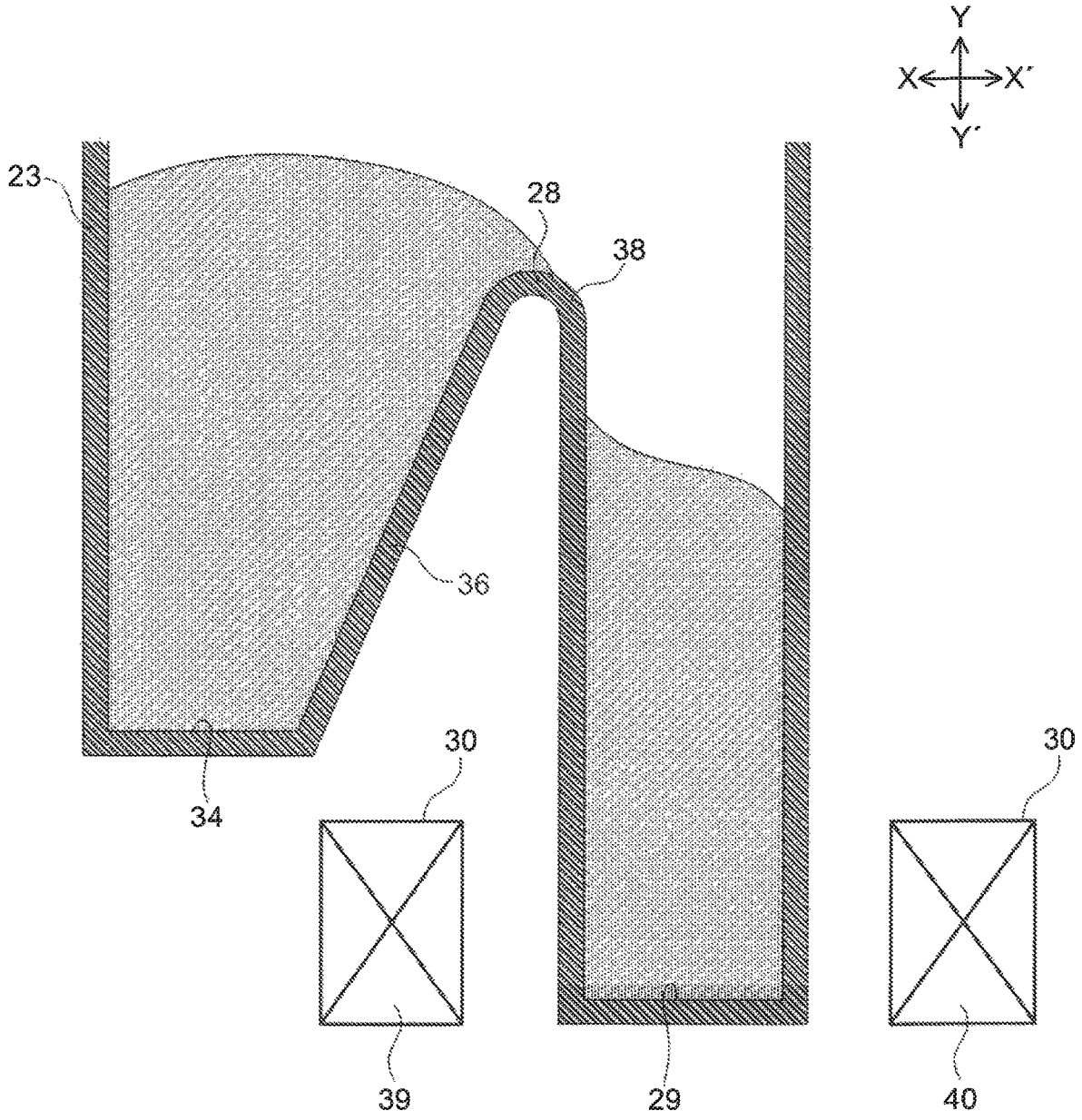
FIG. 9 is a sectional view of the toner collection container showing a state where waste toner is stored in a recessed sensing portion.

FIG. 7 is a sectional view of the toner collection container 23 in a state where waste toner is stored in it. FIG. 8 is a sectional view of the toner collection container 23 shown in FIG. 7 cut along section line E-E'. FIG. 9 is a sectional view of the toner collection container 23 showing a state where waste toner is stored in the recessed sensing portion 29.

As shown in FIG. 7, when the amount of waste toner stored in the toner collection container 23 increases until waste toner has accumulated higher than the bottom end part of the second inclined portion 34, waste toner starts to accumulate in the toner conveying passage 27. As described above, waste toner in the toner conveying passage 27 is inhibited from entering the recessed sensing portion 29 by the side wall 28. However, as shown in FIG. 9, when the amount of waste toner stored in the toner collection container 23 becomes larger than a predetermined amount and the amount of waste toner in the toner conveying passage 27 exceeds a predetermined amount, the waste toner goes over the side wall 28 to enter the recessed sensing portion 29 through the opening 38 and starts to be stored in the recessed sensing portion 29.

The storing of waste toner in the recessed sensing portion 29 proceeds, as the amount of waste toner stored in the toner collection container 23 increases, gradually from the bottom. When the waste toner accumulates up to a predetermined position in the recessed sensing portion 29 in the up-down direction, the light emitted from the light emitting portion 39 is intercepted and the light reception condition in the light receiving portion 40 changes. Then, the control portion displays on the operation screen or the like of the image forming apparatus that a predetermined amount of waste toner is stored in the toner collection container 23.

As described above, the waste toner fed in through the toner collection port 31, while being inhibited from entering the recessed sensing portion 29 by the side wall 28, gradually accumulates in the toner collection container 23. In this way, it is possible to prevent erroneous sensing by the detection sensor 30 due to waste toner attaching to around the detection sensor 30 in the recessed sensing portion 29. Until the amount of waste toner stored in the toner collection container 23 becomes larger than a predetermined amount (at least the amount enough to reach the bottom end part of the second inclined portion 34), waste toner is inhibited from entering the opening 38 by the side wall 28. This helps prevent the detection sensor 30 from sensing waste toner before enough of it is stored in the toner collection container 23. Thus, it is possible to replace the toner collection container 23 efficiently.

As described above, the third inclined portion 36 is formed on the side wall 28. Thus, even when waste toner that has entered the second inclined portion 34 from the first inclined portion 33 collides against the side wall 28, it easily falls onto the second inclined portion 34 along the third inclined portion 36. This helps prevent waste toner from adhering to the side wall 28. In addition, owing to waste toner sliding down on the third inclined portion 36, waste toner in the toner conveying passage 27 concentrates on the second inclined portion 34 more easily. In this way, when a predetermined amount of waste toner is stored in the toner collection container 23, waste toner gradually accumulates starting in the second inclined portion 34 that is located in a bottom portion of the toner conveying passage 27. Thus, it is possible to reduce what is called a dead space where no waste toner accumulates and thereby efficiently store waste toner in the toner collection container 23.

As described above, the inclination angles of the first and second inclined portions 33 and 34 are set to be larger than the angle of repose of waste toner. Thus, the waste toner that has fallen onto the first and second inclined portions 33 and 34 does not stay at where it has fallen but is conveyed to the downstream side of the toner conveying passage 27. This helps prevent the problem of waste toner attaching to the first inclined portion 33 or to the second inclined portion 34 and blocks the toner conveying passage 27 to interfere with the storing of waste toner in the toner collection container 23.

The embodiment described above is in no way meant to limit the present disclosure, which thus allows for many modifications and variations within the spirit of the present disclosure. For example, the present disclosure is applicable not only to tandem-type color printers like the one shown in FIG. 1 but to various types of image forming apparatuses having a waste toner collection mechanism, such as color copiers and printers of a rotary type, monochrome copiers, monochrome printers, digital multifunction peripherals, and facsimile machines.

By mounting a toner collection device according to the present disclosure, it is possible to provide an image forming apparatus that allows replacement of a toner collection container with appropriate timing and with which it is possible to reduce the frequency of replacement of the toner collection container and prevent backflow of waste toner.

What is claimed is:

1. A toner collection device comprising:

a toner collection container having a toner collection port formed therein through which waste toner on a toner carrying member is fed in, the toner collection container being able to store therein the waste toner fed in through the toner collection port;

a toner conveying passage which includes a first inclined portion that is provided right under the toner collection port and that is inclined downward leftward in a left-right direction perpendicular to an up-down direction and a second inclined portion that is connected to a bottom end part of the first inclined portion and that is inclined downward frontward in a front-rear direction perpendicular to the up-down and left-right directions such that an end part of the second inclined portion on a left side thereof makes contact with an inner wall face of the toner collection container on a left side thereof, the toner conveying passage conveying the waste toner fed in through the toner collection port toward a bottom portion of the toner collection container along the first and second inclined portions;

a side wall which rises from an end part of the second inclined portion on a right side thereof;

a recessed sensing portion which has an opening between a top end part of the side wall and the inner wall face of the toner collection container on a right side thereof, the recessed sensing portion extending from the opening rearward in the front-rear direction to communicate with the second inclined portion on a rear side thereof; and a detection sensor which senses presence or absence of the waste toner at a predetermined position in the recessed sensing portion in the up-down direction, wherein the detection sensor is an optical sensor that includes a light emitting portion and a light receiving portion that are located on one side and on another side respectively across the recessed sensing portion in the left-right direction and that senses the presence or absence of the waste toner between the light emitting portion and the light receiving portion based on a light reception condition in the light receiving portion.

2. The toner collection device according to claim 1, wherein the side wall has a third inclined portion which is inclined downward from the top end of the side wall leftward.

3. The toner collection device according to claim 1, wherein inclination angles of the first and second inclined portions are set to be larger than an angle of repose of the waste toner.

4. An image forming apparatus comprising:

an image forming portion which includes a toner carrying member and which forms an image on a recording medium;

a waste toner conveying portion which conveys waste toner on the toner carrying member to a toner collection port; and the toner collection device according to claim 1 which collects the waste toner conveyed by the toner conveying portion.

* * * * *